US006588888B2

(12) United States Patent
Jeanmaire et al.

(10) Patent No.: US 6,588,888 B2
(45) Date of Patent: Jul. 8, 2003

(54) CONTINUOUS INK-JET PRINTING METHOD AND APPARATUS

(75) Inventors: David L. Jeanmaire, Brockport, NY (US); James M. Chwalek, Pittsford, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,232

(22) Filed: Dec. 28, 2000

(65) Prior Publication Data

US 2002/0085071 A1 Jul. 4, 2002

(51) Int. Cl.[7] ..... B41J 2/02; B41J 2/07; B41J 2/075; B41J 2/09

(52) U.S. Cl. ..... 347/77; 347/74; 347/75; 347/82

(58) Field of Search ..... 347/73, 74, 75, 347/77, 82

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,709,432 A | | 1/1973 | Robertson | |
| 3,878,519 A | | 4/1975 | Eaton | |
| 4,068,241 A | * | 1/1978 | Yamada | 347/77 |
| 4,190,844 A | | 2/1980 | Taylor | |
| 4,346,387 A | | 8/1982 | Hertz | |
| 4,350,986 A | * | 9/1982 | Yamada | 347/77 |
| 6,079,821 A | | 6/2000 | Chwalek et al. | |

FOREIGN PATENT DOCUMENTS

| | | | | |
|---|---|---|---|---|
| EP | 494385 | * | 7/1992 | |
| EP | 1016526 | * | 7/2000 | 347/77 |
| EP | 1016527 | * | 7/2000 | 347/77 |
| SU | 581478 | * | 11/1977 | 347/82 |

OTHER PUBLICATIONS

Co–pending U.S. patent application Ser. No. 09/750,946 entitled "Printhead Having Gas Flow Ink Droplet Separation and Method Diverging Ink Droplets", filed Dec. 28, 2000, in the name of Jeanmaire et al.

* cited by examiner

*Primary Examiner*—Huan Tran
(74) *Attorney, Agent, or Firm*—William R. Zimmerli

(57) ABSTRACT

An apparatus for printing an image is provided. The apparatus includes a droplet forming mechanism operable in a first state to form droplets having a first volume travelling along a path and in a second state to form droplets having a plurality of other volumes travelling along the same path. A droplet deflector system applies force to the droplets travelling along the path. The force is applied in a direction such that the droplets having the first volume diverge from the path while the droplets having the plurality of other volumes remain travelling substantially along the path or diverge slightly and begin travelling along a gutter path.

35 Claims, 5 Drawing Sheets

CONTINUOUS INK-JET PRINTING METHOD AND APPARATUS

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color printing capability is accomplished by one of two technologies. Both require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million perceived color combinations.

The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

U.S. Pat. No. 4,914,522 issued to Duffield et al., on Apr. 3, 1990 discloses a drop-on-demand ink jet printer that utilizes air pressure to produce a desired color density in a printed image. Ink in a reservoir travels through a conduit and forms a meniscus at an end of an inkjet nozzle. An air nozzle, positioned so that a stream of air flows across the-meniscus at the end of the ink nozzle, causes the ink to be extracted from the nozzle and atomized into a fine spray. The stream of air is applied at a constant pressure through a conduit to a control valve. The valve is opened and closed by the action of a piezoelectric actuator. When a voltage is applied to the valve, the valve opens to permit air to flow through the air nozzle. When the voltage is removed, the valve closes and no air flows through the air nozzle. As such, the ink dot size on the image remains constant while the desired color density of the ink dot is varied depending on the pulse width of the air stream.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

Typically, continuous ink jet printing devices are faster than droplet on demand devices and produce higher quality printed images and graphics. However, each color printed requires an individual droplet formation, deflection, and capturing system.

Conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control. Examples of conventional continuous ink jet printers include U.S. Pat. No. 1,941,001, issued to Hansell, on Dec. 26, 1933; U.S. Pat. No. 3,373,437 issued to Sweet et al., on Mar. 12, 1968; U.S. Pat. No. 3,416,153, issued to Hertz et al., on Oct. 6, 1963; U.S. Pat. No. 3,878,519, issued to Eaton, on Apr. 15, 1975; and U.S. Pat. No. 4,346,387, issued to Hertz, on Aug. 24, 1982.

U.S. Pat. No. 3,709,432, issued to Robertson, on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets it does rely on the precise control of the break off points of the filaments and the placement of the air flow intermediate to these break off points. Such a system is difficult to control and to manufacture. Furthermore, the physical separation or amount of discrimination between the two droplet paths is small further adding to the difficulty of control and manufacture.

U.S. Pat. No. 4,190,844, issued to Taylor, on Feb. 26, 1980, discloses a continuous ink jet printer having a first pneumatic deflector for deflecting non-printed ink droplets to a catcher and a second pneumatic deflector for oscillating printed ink droplets. A printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink droplet is to be printed or non-printed. The second pneumatic deflector is a continuous type having a diaphram that varies the amount a nozzle is open depending on a varying electrical signal received the central control unit. This oscillates printed ink droplets so that characters may be printed one character at a time. If only the first pneumatic deflector is used, characters are created one line at a time, being built up by repeated traverses of the printhead.

While this method does not rely on electrostatic means to affect the trajectory of droplets it does rely on the precise control and timing of the first ("open/closed") pneumatic deflector to create printed and non-printed ink droplets. Such a system is difficult to manufacture and accurately control resulting in at least the ink droplet build up discussed above. Furthermore, the physical separation or amount of discrimination between the two droplet paths is erratic due to the precise timing requirements increasing the difficulty of controlling printed and non-printed ink droplets resulting in poor ink droplet trajectory control.

Additionally, using two pneumatic deflectors complicates construction of the printhead and requires more components. The additional components and complicated structure require large spatial volumes between the printhead and the media, increasing the ink droplet trajectory distance. Increasing the distance of the droplet trajectory decreases droplet placement accuracy and affects the print image quality. Again, there is a need to minimize the distance the droplet must travel before striking the print media in order to insure high quality images. Pneumatic operation requiring the air flows to be turned on and off is necessarily slow in that an inordinate amount of time is needed to perform the mechanical actuation as well as settling any transients in the air flow.

U.S. Pat. No. 6,079,821, issued to Chwalek et al., on Jun. 27, 2000, discloses a continuous ink jet printer that uses actuation of asymmetric heaters to create individual ink droplets from a filament of working fluid and deflect thoses ink droplets. A printhead includes a pressurized ink source and an asymmetric heater operable to form printed ink droplets and non-printed ink droplets. Printed ink droplets flow along a printed ink droplet path ultimately striking a print media, while non-printed ink droplets flow along a non-printed ink droplet path ultimately striking a catcher surface. Non-printed ink droplets are recycled or disposed of through an ink removal channel formed in the catcher.

While the ink jet printer disclosed in Chwalek et al. works extremely well for its intended purpose, using a heater to create and deflect ink droplets increases the energy and power requirements of this device.

U.S. patent application entitled *Printhead Having Gas Flow Ink Droplet Separation And Method Of Diverging Ink Droplets,* filed concurrently herewith and commonly assigned, discloses a printing apparatus. The apparatus includes a droplet deflector system and droplet forming mechanism. During printing, a plurality of ink droplets having large and small volumes are formed in a stream. The droplet deflector system interacts with the stream of ink droplets causing individual ink droplets to separate depending on each droplets volume. Accordingly, large volume droplets can be permitted to strike a print media while small volume droplets are deflected as they travel downward and strike a catcher surface.

While the apparatus described above works extremely well for its intended purpose, images printed with large volume ink droplets typically have a lower resolution than images printed with small volume ink droplets.

It can be seen that there is a need to provide an ink jet printhead and printer of simple construction having reduced energy and power requirements capable of rendering high resolution images on a wide variety of materials using a wide variety of inks.

SUMMARY OF THE INVENTION

An object of the present invention is to simplify construction of a continuous ink jet printhead and printer.

Another object of the present invention is to reduce energy and power requirements of a continuous ink jet printhead and printer.

Yet another object of the present invention is to provide a continuous ink jet printhead and printer capable of rendering high resolution images using large volumes of ink.

Yet another object of the present invention is to provide a continuous ink jet printhead and printer capable of printing with a wide variety of inks on a wide variety of materials.

According to a feature of the present invention, an apparatus for printing an image includes a droplet forming mechanism operable in a first state to form droplets having a first volume travelling along a path and in a second state to form droplets having a plurality of other volumes travelling along the same path. Each of the plurality of other volumes being greater than the first volume. A droplet deflector system applies force to the droplets travelling along the path with the force being applied in a direction such that the droplets having the first volume diverge from the path.

According to another feature of the present invention an apparatus for printing an image includes a droplet forming mechanism operable in a first state to form printed droplets travelling along a path and in a second state to form non-printed droplets travelling along the same path. A system applies force to the printed droplets and the non-printed droplets travelling along the path with the force being applied in a direction such that the printed droplets diverge from the path and begin travelling along a printed path.

According to another feature of the present invention, a method of diverging ink droplets includes forming droplets having a first volume travelling along a path; forming droplets having a plurality of other volumes travelling along the path; and causing the droplets having the first volume to diverge from the path.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
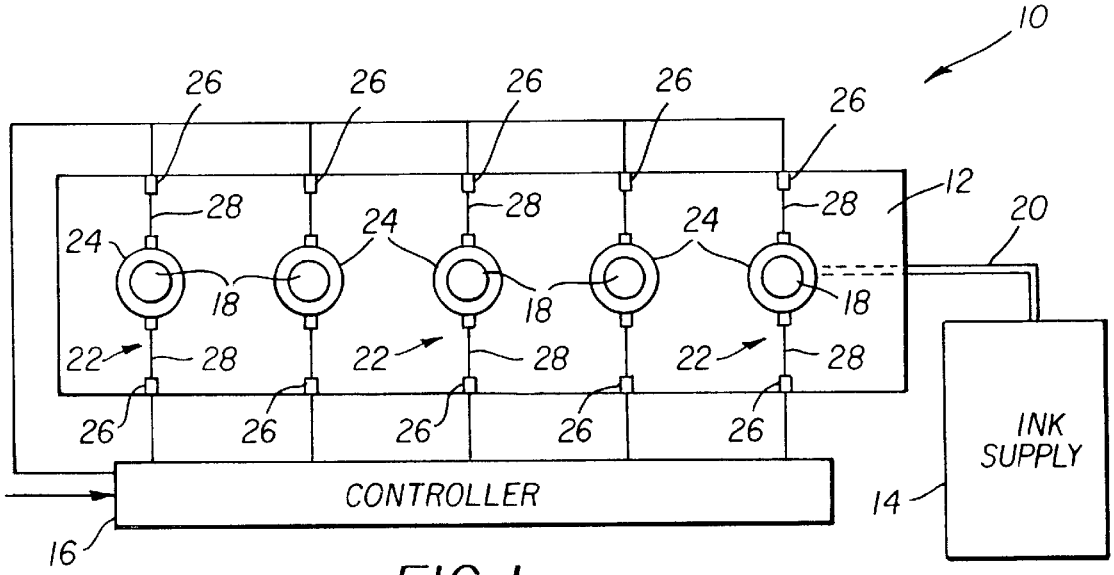
FIG. 1 is a schematic plan view of a printhead made in accordance with a preferred embodiment of the present invention.

Referring to FIG. 1, an ink droplet forming mechanism 10 of a preferred embodiment of the present invention is shown. Ink droplet forming mechanism 10 includes a printhead 12, at least one ink supply 14, and a controller 16. Although ink droplet forming mechanism 10 is illustrated schematically and not to scale for the sake of clarity, one of ordinary skill in the art will be able to readily determine the specific size and interconnections of the elements of the preferred.

In a preferred embodiment of the present invention, printhead 12 is formed from a semiconductor material (silicon, etc.) using known semiconductor fabrication techniques (CMOS circuit fabrication techniques, micro-electro mechanical structure (MEMS) fabrication techniques, etc.). However, it is specifically contemplated and, therefore within the scope of this disclosure, that printhead 12 may be formed from any materials using any fabrication techniques conventionally known in the art.

Again referring to FIG. 1, at least one nozzle 18 is formed on printhead 12. Nozzle 18 is in fluid communication with ink supply 14 through an ink passage 20 also formed in printhead 12. It is specifically contemplated, therefore within the scope of this disclosure, that printhead 12 may incorporate additional ink supplies and corresponding nozzles 18 in order to provide color printing using three or more ink colors. Additionally, black and white or single color printing may be accomplished using a single ink supply 14 and nozzle 18.

A heater 22 is at least partially formed or positioned on printhead 12 around a corresponding nozzle 18. Although heater 22 may be disposed radially away from an edge of corresponding nozzle 18, heater 22 is preferably disposed close to corresponding nozzle 18 in a concentric manner. In a preferred embodiment, heater 22 is formed in a substantially circular or ring shape. However, it is specifically contemplated, therefore within the scope of this disclosure, that heater 22 may be formed in a partial ring, square, etc. Heater 22 in a preferred embodiment includes an electric resistive heating element 24 electrically connected to electrical contact pads 26 via conductors 28.

Conductors 28 and electrical contact pads 26 may be at least partially formed or positioned on printhead 12 and provide an electrical connection between controller 16 and heater 22. Alternatively, the electrical connection between controller 16 and heater 22 may be accomplished in any well known manner. Additionally, controller 16 may be a relatively simple device (a power supply for heater 22, etc.) or a relatively complex device (logic controller, programmable microprocessor, etc.) operable to control many components (heater 22, ink droplet forming mechanism 10, print drum 80, etc.) in a desired manner.

Figure 2A:
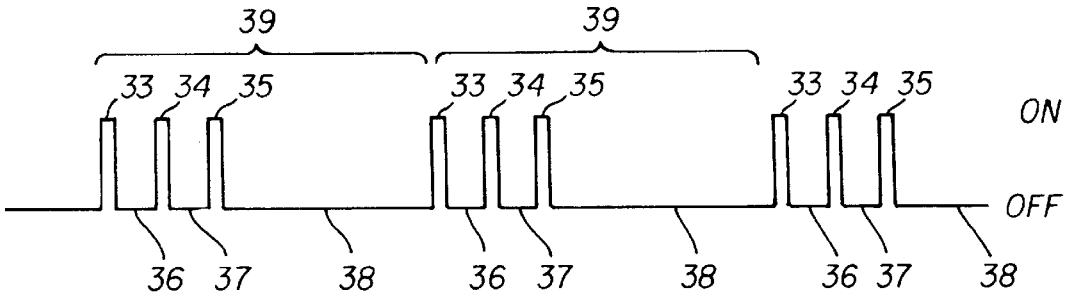
FIGS. 2A through 2F are diagrams illustrating a frequency control of a heater used in the preferred embodiment of FIG. 1 and the resulting ink droplets.
Figure 2B:
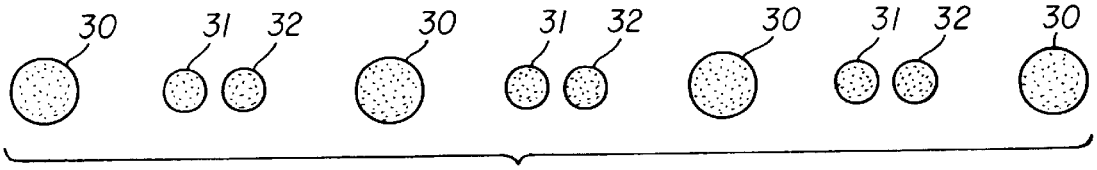

Referring to FIGS. 2A and 2B, an example of the electrical activation waveform provided by controller 16 to heater 22 is shown generally in FIG. 2A. Individual ink droplets 30, 31, and 32 resulting from the jetting of ink from nozzle 18, in combination with this heater actuation, are shown schematically in FIG. 2B. A high frequency of activation of heater 22 results in small volume droplets 31, 32, while a low frequency of activation of heater 22 results in large volume droplets 30.

In a preferred implementation, which allows for the printing of multiple droplets per image pixel, a time 39 associated with printing of an image pixel includes time sub-intervals reserved for the creation of small printing droplets 31, 32 plus time for creating one larger non-printing droplet 30. In FIG. 2A only time for the creation of two small printing droplets 31, 32 is shown for simplicity of illustration, however, it should be understood that the reservation of more time for a larger count of printing droplets is clearly within the scope of this invention.

When printing each image pixel, large droplet 30 is created through the activation of heater 22 with electrical pulse time 33, typically from 0.1 to 10 microseconds in duration, and more preferentially 0.5 to 1.5 microseconds. The additional (optional) activation of heater 22, after delay time 36, with an electrical pulse 34 is conducted in accordance with image data wherein at least one printing droplet is required. When image data requires another printing droplet be created, heater 22 is again activated after delay 37, with a pulse 35.

Heater activation electrical pulse times 33, 34, and 35 are substantially similar, as are delay times 36 and 37. Delay times 36 and 37 are typically 1 to 100 microseconds, and more preferentially, from 3 to 6 microseconds. Delay time 38 is the remaining time after the maximum number of printing droplets have been formed and the start of electrical pulse time 33, concomitant with the beginning of the next image pixel with each image pixel time being shown generally at 39. The sum of heater 22 electrical pulse time 33 and delay time 38 is chosen to be significantly larger than the sum of a heater activation time 34 or 35 and delay time 36 or 37, so that the volume ratio of large non-printing-droplets to small printing-droplets is preferentially a factor of four (4) or greater. It is apparent that heater 22 activation may be controlled independently based on the ink color required and ejected through corresponding nozzle 18, movement of printhead 12 relative to a print media W, and an image to be printed. It is specifically contemplated, and therefore within the scope of this disclosure that the absolute volume of the small droplets 31 and 32 and the large droplets 30 may be adjusted based upon specific printing requirements such as ink and media type or image format and size. As such, reference below to large volume non-printed droplets 30 and small volume printed droplets 31 and 32 is relative in context for example purposes only and should not be interpreted as being limiting in any manner.

Figure 2C:
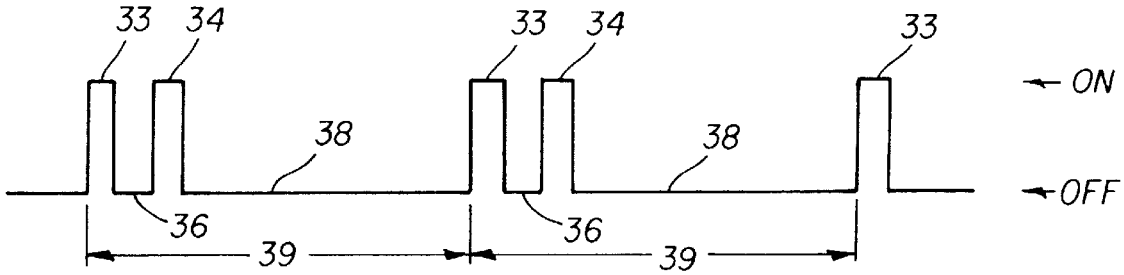
Figure 2D:
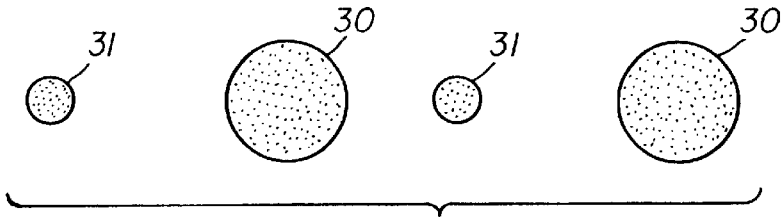
Figure 2E:
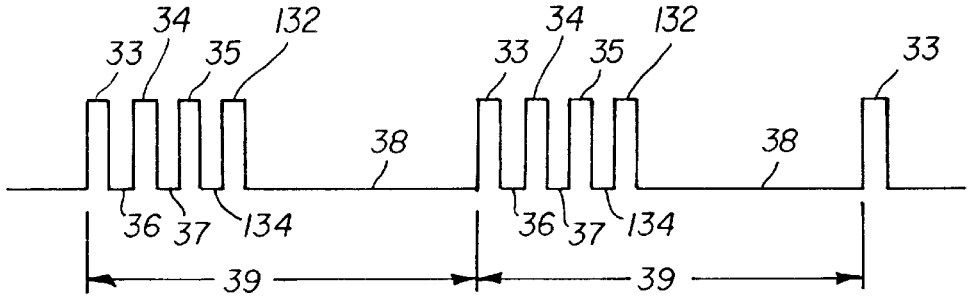
Figure 2F:
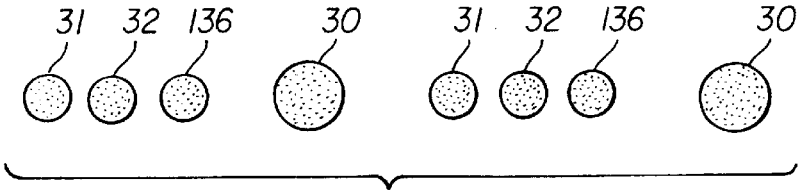

Referring to FIGS. 2C through 2F, as each image pixel time 39 remains substantially constant in a preferred embodiment of the invention, large droplet 30 will vary in size, volume, and mass depending on the number of small droplets 31, 32, 136 produced by heater 22. In FIGS. 2C and 2D, only one small droplet 31 is produced. As such, the volume of large droplet 30 is increased relative to the volume of large droplet 30 in FIGS. 2B and 2F. In FIGS. 2E and 2F, multiple small droplets 31, 32, 136 are produced. As such, the volume of large droplet 30 is decreased relative to the volume of large droplet 30 in FIGS. 2B and 2D. The volume of large droplets 30 in FIG. 2F is still greater than the volume of small droplets 31, 32, 136, preferably by at least a factor of four (4) in a preferred embodiment as described above. Droplet 136 is produced by activating heater 22 for an electrical pulse time 132 after heater 22 has been deactivated by a delay time 134.

In a preferred implementation, small droplets 31, 32, 136 form printed droplets that impinge on print media W while large droplets 30 are collected by ink guttering structure 60. However, it is specifically contemplated that large droplets 30 can form printed droplets while small droplets 31, 32, 136 are collected by ink guttering structure 60. This can be accomplished by repositioning ink guttering structure 60, in any known manner, such that ink guttering structure 60 collects small droplets 31, 32, 136. Printing in this manner provides printed droplets having varying sizes and volumes.

Figure 3:
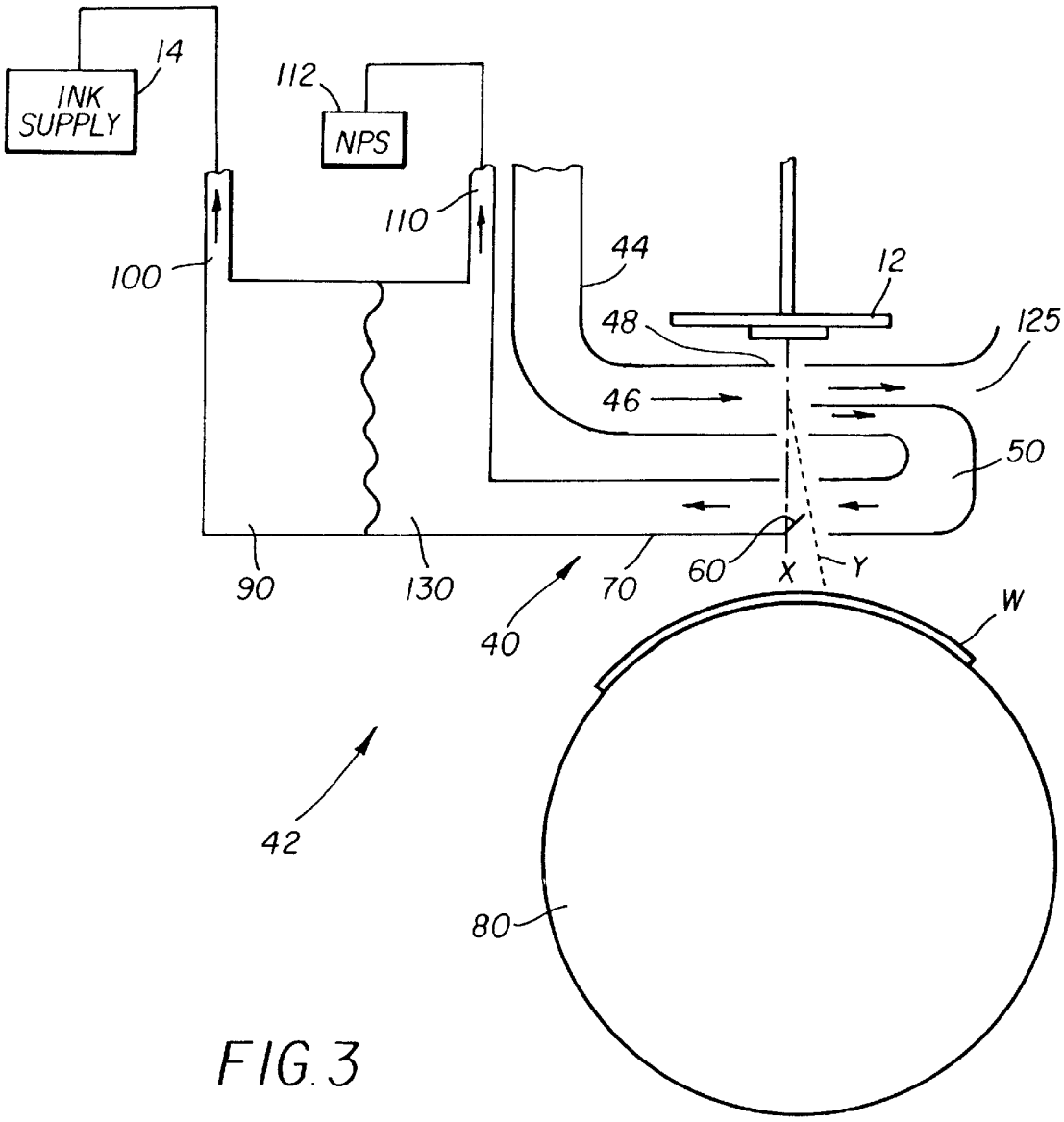
FIG. 3 is a schematic view of an ink jet printer made in accordance with the preferred embodiment of the present invention.

Referring to FIG. 3, one embodiment of a printing apparatus 42 (typically, an ink jet printer or printhead) made in accordance with the present invention is shown. Large volume ink droplets 30 and small volume ink droplets 31 and 32 are ejected from printhead 12 substantially along path X in a stream. A droplet deflector system 40 applies a force (shown generally at 46) to ink droplets 30, 31, and 32 as ink droplets 30, 31, and 32 travel along path X. Force 46 interacts with ink droplets 30, 31, and 32 along path X, causing the ink droplets 31 and 32 to alter course. As ink droplets 30 have different volumes and masses from ink droplets 31 and 32, force 46 causes small droplets 31 and 32 to separate from large droplets 30 with small droplets 31 and 32 diverging from path X along small droplet or printed path Y. While large droplets 30 can be slightly affected by force 46, large droplets 30 remain travelling substantially along path X. However, as the volume of large droplets 30 is decreased, large droplets 30 can diverge slightly from path X and begin traveling along a gutter path Z (shown in greater detail with reference to FIG. 4). The interaction of force 46 with ink droplets 30, 31, and 32 is described in greater detail below with reference to FIG. 4.

Droplet deflector system 40 can include a gas source that provides force 46. Typically, force 46 is positioned at an angle with respect to the stream of ink droplets operable to selectively deflect ink droplets depending on ink droplet volume. Ink droplets having a smaller volume are deflected more than ink droplets having a larger volume.

Droplet deflector system 40 facilitates laminar flow of gas through a plenum 40. An end 48 of the droplet deflector system 40 is positioned proximate path X. An ink recovery conduit 70 is disposed opposite a recirculation plenum 50 of droplet deflector system 40 and promotes laminar gas flow while protecting the droplet stream moving along path X from air external air disturbances. Ink recovery conduit 70 contains a ink guttering structure 60 whose purpose is to intercept the path of large droplets 30, while allowing small ink droplets 31, 32, traveling along small droplet path Y, to continue on to a recording media W carried by a print drum 80.

Ink recovery conduit 70 communicates with an ink recovery reservoir 90 to facilitate recovery of non-printed ink droplets by an ink return line 100 for subsequent reuse. Ink recovery reservoir 90 can include an open-cell sponge or foam 130, which prevents ink sloshing in applications where the printhead 12 is rapidly scanned. A vacuum conduit 110, coupled to a negative pressure source 112 can communicate with ink recovery reservoir 90 to create a negative pressure in ink recovery conduit 70 improving ink droplet separation and ink droplet removal. The gas flow rate in ink recovery conduit 70, however, is chosen so as to not significantly perturb small droplet path Y. Additionally, gas recirculation plenum 50 diverts a small fraction of the gas flow crossing ink droplet path X to provide a source for the gas which is drawn into ink recovery conduit 70.

In a preferred implementation, the gas pressure in droplet deflector system 40 and in ink recovery conduit 70 are adjusted in combination with the design of ink recovery conduit 70 and recirculation plenum 50 so that the gas pressure in the print head assembly near ink guttering structure 60 is positive with respect to the ambient air pressure near print drum 80. Environmental dust and paper fibers are thusly discouraged from approaching and adhering to ink guttering structure 60 and are additionally excluded from entering ink recovery conduit 70.

In operation, a recording media W is transported in a direction transverse to path X by print drum 80 in a known manner. Transport of recording media W is coordinated with movement of print mechanism 10 and/or movement of printhead 12. This can be accomplished using controller 16 in a known manner.

Figure 4:
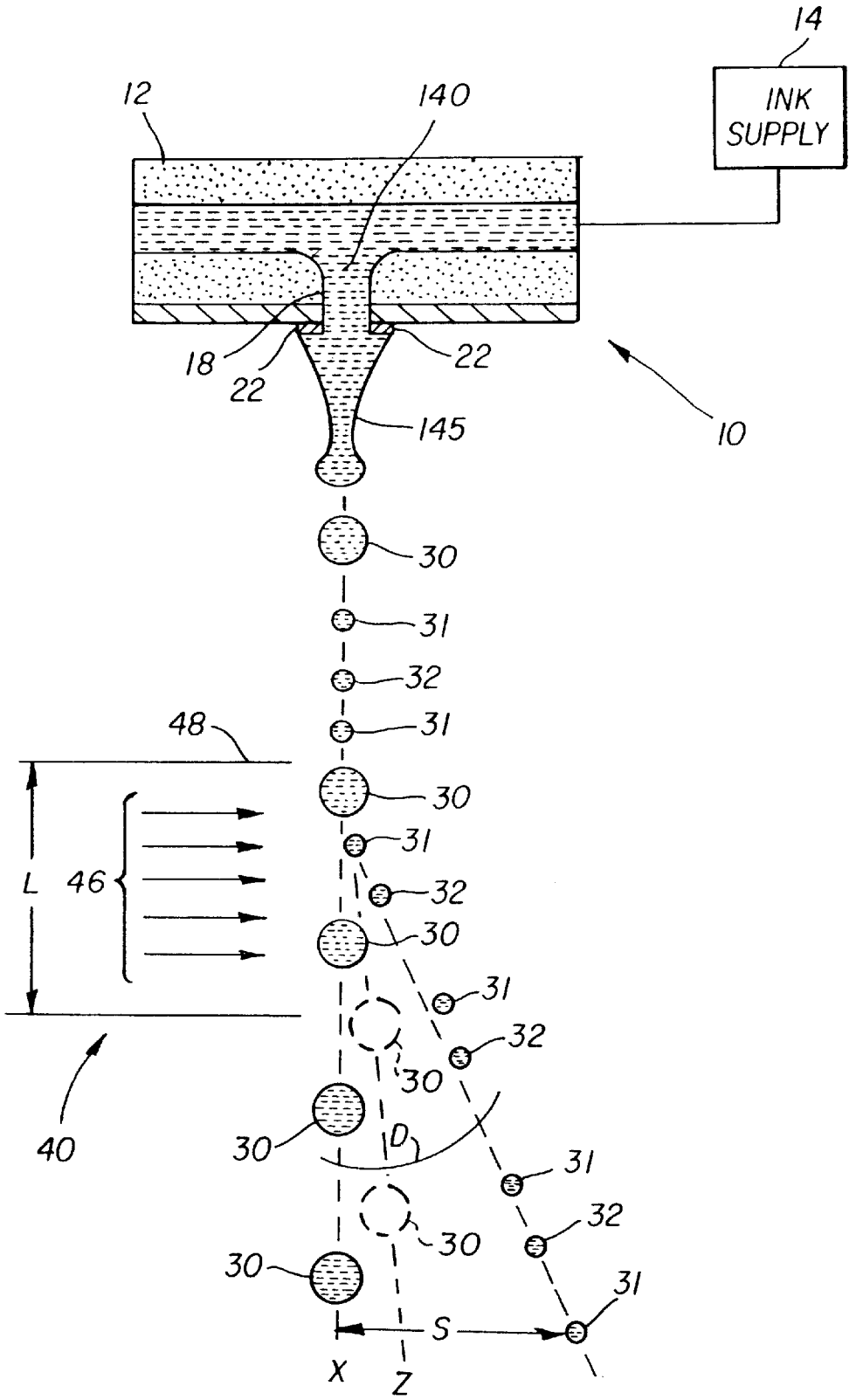
FIG. 4 is a partial cross-sectional schematic view of an ink jet printhead made in accordance with the preferred embodiment of the present invention.

Referring to FIG. 4, another embodiment of the present invention is shown. Pressurized ink 140 from ink supply 14 is ejected through nozzle 18 of printhead 12 creating a filament of working fluid 145. Droplet forming mechanism 138, for example heater 22, is selectively activated at various frequencies causing filament of working fluid 145 to break up into a stream of individual ink droplets 30, 31, 32 with the volume of each ink droplet 30, 31, 32 being determined by the frequency of activation of heater 22.

During printing, droplet forming mechanism 138, for example, heater 22, is selectively activated creating the stream of ink having a plurality of ink droplets having a plurality of volumes and droplet deflector system 40 is operational. After formation, large volume droplets 30 also have a greater mass and more momentum than small volume droplets 31 and 32. As gas force 46 interacts with the stream of ink droplets, the individual ink droplets separate depending on each droplets volume and mass. Accordingly, the gas flow rate in droplet deflector system 40 can be adjusted to sufficient differentiation in the small droplet path Y from the large droplet path X, permitting small volume droplets 31 and 32 to strike print media W while large volume droplets 30 travel downward remaining substantially along path X or diverging slightly and travelling along gutter path Z. Ultimately, droplets 30 strike ink guttering structure 60 or otherwise to fall into recovery conduit 70.

In a preferred embodiment, a positive force 46 (gas pressure or gas flow) at end 48 of droplet deflector system 40 tends to separate and deflect ink droplets 31 and 32 away from ink recovery conduit 70 as ink droplets 31, 32 travel toward print media W. An amount of separation between large volume droplets 30 and small volume droplets 31 and 32 (shown as S in FIG. 4) will not only depend on their relative size but also the velocity, density, and viscosity of the gas coming from droplet deflector system 40; the velocity and density of the large volume droplets 30 and small volume droplets 31 and 32; and the interaction distance (shown as L in FIG. 4) over which the large volume droplets 30 and the small volume droplets 31 and 32 interact with the gas flowing from droplet deflector system 40 with force 46. Gases, including air, nitrogen, etc., having different densities and viscosities can be used with similar results.

Large volume droplets 30 and small volume droplets 31 and 32 can be of any appropriate relative size. However, the droplet size is primarily determined by ink flow rate through nozzle 18 and the frequency at which heater 22 is cycled. The flow rate is primarily determined by the geometric properties of nozzle 18 such as nozzle diameter and length, pressure applied to the ink, and the fluidic properties of the ink such as ink viscosity, density, and surface tension. As such, typical ink droplet sizes may range from, but are not limited to, 1 to 10,000 picoliters.

Although a wide range of droplet sizes are possible, at typical ink flow rates, for a 10 micron diameter nozzle, large volume droplets 30 can be formed by cycling heaters at a frequency of about 50 kHz producing droplets of about 20 picoliter in volume and small volume droplets 31 and 32 can be formed by cycling heaters at a frequency of about 200 kHz producing droplets that are about 5 picoliter in volume. These droplets typically travel at an initial velocity of 10 m/s. Even with the above droplet velocity and sizes, a wide range of separation distances S between large volume and small volume droplets is possible depending on the physical properties of the gas used, the velocity of the gas and the interaction distance L, as stated previously. For example, when using air as the gas, typical air velocities may range from, but are not limited to 100 to 1000 cm/s while interaction distances L may range from, but are not limited to, 0.1 to 10 mm.

Nearly all fluids have a non-zero change in surface tension with temperature. Heater 22 is therefore able to break up working fluid 145 into droplets 30, 31, 32, allowing print mechanism 10 to accommodate a wide variety of inks, since the fluid breakup is driven by spatial variation in surface tension within working fluid 145, as is well known in the art. The ink can be of any type, including aqueous and non-aqueous solvent based inks containing either dyes or pigments, etc. Additionally, plural colors or a single color ink can be used.

The ability to use any type of ink and to produce a wide variety of droplet sizes, separation distances (shown as S in FIG. 4), and droplet deflections (shown as divergence angle D in FIG. 4) allows printing on a wide variety of materials including paper, vinyl, cloth, other fibrous materials, etc. The invention also has very low energy and power requirements because only a small amount of power is required to form large volume droplets 30 and small volume droplets 31 and 32. Additionally, print mechanism 10 does not require electrostatic charging and deflection devices, and the ink need not be in a particular range of electrical conductivity. While helping to reduce power requirements, this also simplifies construction of ink droplet forming mechanism 10 and control of droplets 30, 31 and 32.

Printhead 12 can be manufactured using known techniques, such as CMOS and MEMS techniques. Additionally, printhead 12 can incorporate a heater, a piezoelectric actuator, a thermal actuator, etc., in order to create ink droplets 30, 31, 32. There can be any number of nozzles 18 and the distance between nozzles 18 can be adjusted in accordance with the particular application to avoid ink coalescence, and deliver the desired resolution.

Printhead 12 can be formed using a silicon substrate, etc. Also, printhead 12 can be of any size and components thereof can have various relative dimensions. Heater 22, electrical contact pad 26, and conductor 28 can be formed and patterned through vapor deposition and lithography techniques, etc. Heater 22 can include heating elements of any shape and type, such as resistive heaters, radiation heaters, convection heaters, chemical reaction heaters (endothermic or exothermic), etc. The invention can be controlled in any appropriate manner. As such, controller 16 can be of any type, including a microprocessor based device having a predetermined program, etc.

Droplet deflector system 40 can be of any type and can include any number of appropriate plenums, conduits, blowers, fans, etc. Additionally, droplet deflector system 40 can include a positive pressure source, a negative pressure source, or both, and can include any elements for creating a pressure gradient or gas flow. Ink recovery conduit 70 can be of any configuration for catching deflected droplets and can be ventilated if necessary.

Print media W can be of any type and in any form. For example, the print media can be in the form of a web or a sheet. Additionally, print media W can be composed from a wide variety of materials including paper, vinyl, cloth, other large fibrous materials, etc. Any mechanism can be used for moving the printhead relative to the media, such as a conventional raster scan mechanism, etc.

Figure 5:
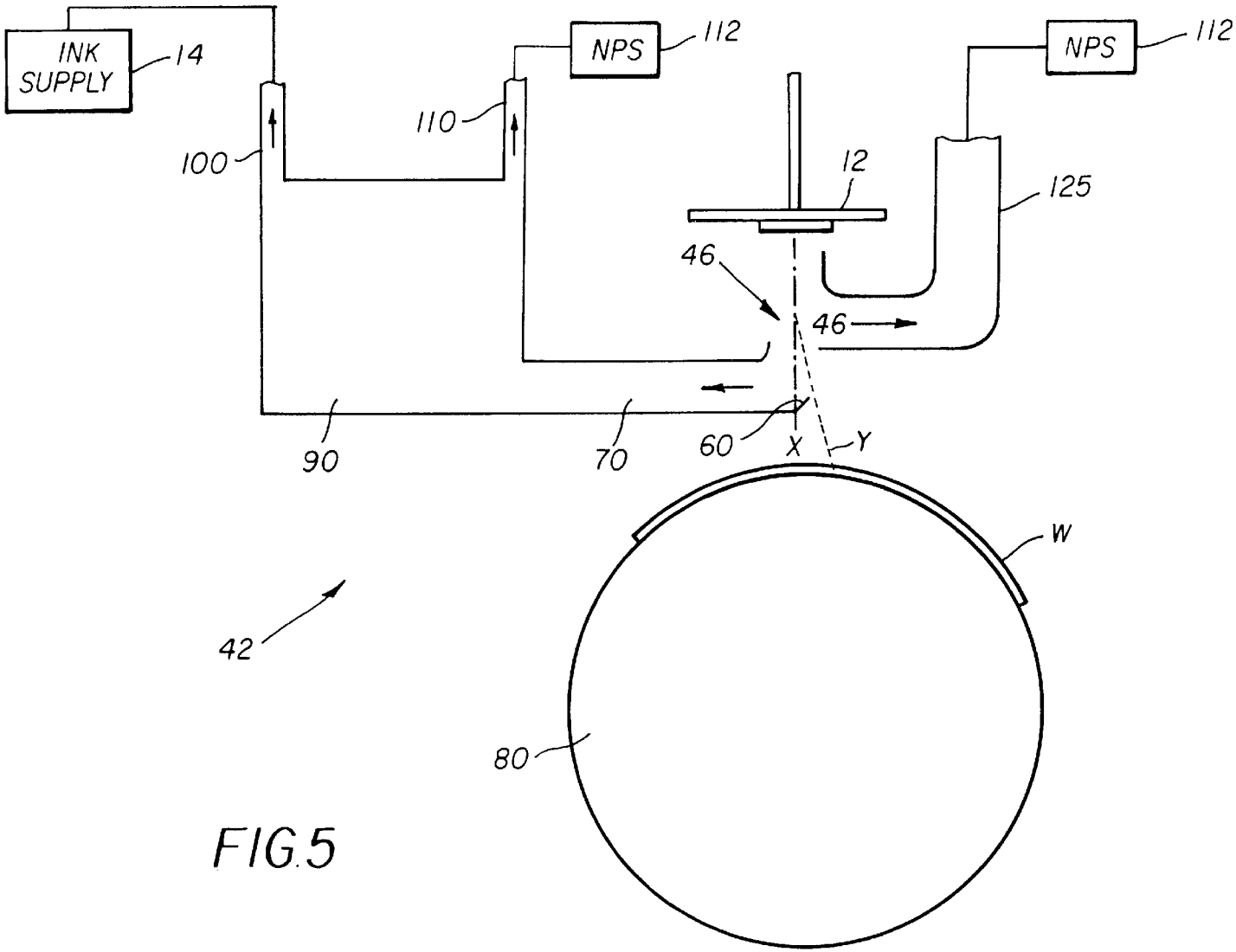
FIG. 5 is schematic view of an ink jet printer made in accordance with an alternative embodiment of the present invention.

Referring to FIG. 5, another embodiment of the present invention is shown with like elements being described using like reference signs. Deflector plenum 125 applies force (shown generally at 46) to ink droplets 30, 31 and 32 as ink droplets 30, 31 and 32 travel along path X. Force 46 interacts with ink droplets 30, 31 and 32 along path X, causing ink droplets 31 and 32 to alter course. As ink droplets 30, 31, and 32 have different volumes and masses, force 46 causes small droplets 31 and 32 to separate from large droplets 30 with small droplets 31 and 32 diverging from path X along path small droplet path Y. Large droplets 30 can be slightly affected by force 46. As such, large droplets 30 either continue to travel along large droplet path X or diverge slightly and begin travelling along gutter path Z which is only slightly deviated from path X. In FIG. 5, force 46 originates from a negative pressure created by a vacuum source, negative pressure source 112, etc. and communicated through deflector plenum 125.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An apparatus for printing an image comprising:

a droplet forming mechanism operable in a first state to form droplets having a first volume travelling along a path and in a second state to form droplets having a plurality of other volumes travelling along said path, each of said plurality of other volumes being greater than said first volume; and a droplet deflector system which applies force to said droplets travelling along said path, said force being applied in a direction such that said droplets having said first volume diverge from said path, wherein said force includes a gas flow continuously applied to the droplets having the first volume and the droplets having the plurality of other volumes, wherein said droplet forming mechanism includes a heater.

2. The apparatus according to claim 1, wherein said force is applied in a direction substantially perpendicular to said path.

3. The apparatus according to claim 1, wherein said force is applied to said droplets travelling along said path such that said droplets having said plurality of other volumes remain travelling substantially along said path.

4. The apparatus according to claim 3, further comprising:

a gutter shaped to collect said droplets having said plurality of other volumes positioned at an end of said path.

5. The apparatus according to claim 1, wherein said force is applied to said droplets travelling along said path such that said droplets having said plurality of other volumes diverge from said path and begin travelling along a gutter path.

6. The apparatus according to claim 5, further comprising:

a gutter positioned at an end of said gutter path shaped to collected said droplets having said plurality of other volumes.

7. The apparatus according to claim 1, wherein said droplets forming mechanism is operable in the first state to form a succession of droplets having the first volume travelling along the path.

8. An apparatus for printing an image comprising:

a droplet forming mechanism operable in a first state to form droplets having a first volume travelling along a path and in a second state to form droplets having a plurality of other volumes travelling along said path, each of said plurality of other volumes being greater than said first volume; and a droplet deflector system which applies force to said droplets travelling along said path, said force being applied in a direction such that said droplets having said first volume diverge from said path, wherein said force is a negative pressure force, wherein said droplet forming mechanism includes a heater.

9. The apparatus according to claim 8, wherein said negative pressure force is a negative pressure gas flow.

10. An apparatus for printing an image comprising:

a droplet forming mechanism operable in a first state to form droplets having a first volume travelling along a path and in a second state to form droplets having a plurality of other volumes travelling along said path, each of said plurality of other volumes being greater than said first volume; and a droplet deflector system which applies force to said droplets travelling along said path, said force being applied in a direction such that said droplets having said first volume diverge from said path, wherein said force is a negative pressure force, wherein said drop forming mechanism is operable in the first state to form a succession of droplets having the first volume travelling along the path.

11. The apparatus according to claim 10, wherein said negative pressure force is a negative pressure gas flow.

12. An apparatus for printing an image comprising:

a droplet forming mechanism operable in a first state to form droplets having a first volume travelling along a path and in a second state to form droplets having a plurality of other volumes travelling along said path, each of said plurality of other volumes being greater than said first volume; and a droplet deflector system which applies force to said droplets travelling along said path, said force being applied in a direction such that said droplets having said first volume diverge from said path, wherein said droplet forming mechanism includes a heater operable in said first state to form said droplets having said first volume travelling along said path and in said second state to form said droplets having said plurality of other volumes travelling along said path.

13. The apparatus according to claim 12, further comprising:

a controller in electrical communication with said heater, wherein said heater is activated at a plurality of frequencies by said controller.

14. The apparatus according to claim 12, wherein said force includes a continuous gas flow.

15. The apparatus according to claim 12, wherein said droplet deflector system includes a negative pressure force.

16. The apparatus according to claim 15, wherein said negative pressure force is a negative pressure gas flow.

17. The apparatus according to claim 12, wherein said drop forming mechanism is operable in the first state to form a succession of droplets having the first volume travelling along the path.

18. An apparatus for printing an image comprising:

a droplet forming mechanism operable in a first state to form a succession of printed droplets travelling along a path and in a second state to form non-printed droplets travelling along said path; and a system which applies force to said printed droplets and said non-printed droplets travelling along said path, said force being applied in a direction such that said printed droplets diverge from said path and begin travelling along a printed path, wherein said force includes a gas flow continuously applied to said printed droplets and said non-printed droplets.

19. The apparatus according to claim 18, further comprising:

a gutter positioned at an end of said path shaped to collect said non-printed droplets.

20. The apparatus according to claim 18, wherein said printed droplets have a first volume.

21. The apparatus according to claim 20, wherein said non-printed droplets have a plurality of other volumes, each of said plurality of other volumes being greater than said first volume.

22. The apparatus according to claim 21, wherein at least one of said non-printed droplets diverge from said path and begin travelling along a gutter path.

23. The apparatus according to claim 22, further comprising:

a gutter positioned at an end of said gutter path shaped to collect said non-printed droplets.

24. The apparatus according to claim 20, wherein at least one of said non-printed droplets remain travelling substantially along said path.

25. The apparatus according to claim 24, further comprising:

a gutter positioned at an end of said path shaped to collect said non-printed droplets.

26. The apparatus according to claim 20, wherein said non-printed droplets have a second volume, said second volume being greater than said first volume.

27. The apparatus according to claim 18, wherein said droplet forming mechanism includes a heater.

28. A method of diverging ink droplets comprising:

forming droplets having a first volume travelling along a path;

forming droplets having a plurality of other volumes travelling along the path; and causing at least the droplets having the first volume to diverge from the path by applying a force to at least the droplets having the first volume in a direction such that the droplets having the first volume diverge from the path, the force including a gas flow continuously applied to the droplets having the first volume and the droplets having the plurality of other volumes, wherein forming the droplets having the first volume and forming the droplets having the plurality of other volumes includes using heat.

29. The method according to claim 28, wherein applying the force includes applying the force along the path.

30. The method according to claim 28, wherein applying the force includes applying the force in a direction substantially perpendicular to the path.

31. The method according to claim 28, wherein causing at least the droplets having the first volume to diverge from the path includes applying the force to the droplets having the plurality of other volumes when the force is applied to the droplets having the first volume.

32. The method according to claim 31, further comprising:

collecting the droplets having the plurality of other volumes in a gutter.

33. The method according to claim 32, wherein collecting the droplets having the plurality of other volumes includes collecting at least some droplets having the plurality of other volumes that have diverged from the path and begun travelling along a gutter path.

34. The method according to claim 32, wherein collecting the droplets having the plurality of other volumes includes collecting at least some droplets having the plurality of other volumes that have remained travelling substantially along the path.

35. The method according to claim 28, wherein forming droplets having the first volume includes forming a succession of the droplets having the first volume travelling along the path.

* * * * *